US005801728A

United States Patent [19]

Yanagi et al.

[11] Patent Number: 5,801,728

[45] Date of Patent: Sep. 1, 1998

[54] INFORMATION PROCESSING APPARATUS AND ELASTIC MEMBER PROVIDED IN ELECTRICAL CONNECTION EMPLOYED THEREIN

[75] Inventors: Haruyuki Yanagi, Machida; Tetsuo Suzuki, Yokohama; Soichi Hiramatsu, Hachioji; Masahiro Taniguro, Ushiku; Hiroyuki Inoue; Hiroyuki Saito, both of Yokohama; Koichi Tanno, Kawasaki; Makoto Kawarama, Kawasaki; Hiroyuki Kinoshita, Kawasaki; Masaya Shinmachi, Kawasaki; Tan At Ming, Kawasaki, all of Japan

[73] Assignee: Canon Kabushiki Kaisha, Tokyo, Japan

[21] Appl. No.: 511,229

[22] Filed: Aug. 4, 1995

[30] Foreign Application Priority Data

Aug. 4, 1994 [JP] Japan ..... 6-183682
Aug. 1, 1995 [JP] Japan ..... 7-196608

[51] Int. Cl.[6] ..... B41J 29/02

[52] U.S. Cl. ..... 347/50; 439/66; 439/67

[58] Field of Search ..... 347/50; 439/67, 439/66

[56] References Cited

U.S. PATENT DOCUMENTS

| | | | |
|---|---|---|---|
| 3,989,131 | 11/1976 | Knirsch et al. | 197/1 R |
| 4,555,715 | 11/1985 | Vegeais et al. | 346/76 |
| 4,706,097 | 11/1987 | Harmon | 346/139 C |
| 5,515,086 | 5/1996 | Kakizaki et al. | 347/50 |

FOREIGN PATENT DOCUMENTS

| | | |
|---|---|---|
| 0622233 | 11/1994 | European Pat. Off. . |
| 3425178 | 1/1985 | Germany . |
| 1125238 | 5/1989 | Japan . |
| 1148566 | 6/1989 | Japan . |
| 1209786 | 8/1989 | Japan . |
| 2299858 | 12/1990 | Japan . |

*Primary Examiner*—Daniel P. Malley
*Attorney, Agent, or Firm*—Fitzpatrick, Cella, Harper & Scinto

[57] ABSTRACT

A rubber member for use in an electrical connector for making electrical connection by pressing of mutually opposed contacts is provided with a sheet member contact pins protruding on top and rear faces of the sheet member, for pressing one of the contacts to the other, and a stabilizing rib protruding from the sheet member with a smaller height than that of the contact pins.

15 Claims, 21 Drawing Sheets

INFORMATION PROCESSING APPARATUS AND ELASTIC MEMBER PROVIDED IN ELECTRICAL CONNECTION EMPLOYED THEREIN

BACKGROUND OF THE INVENTION

1. Field of the Invention

The present invention relates to an information processing apparatus provided, in a head mounting unit for mounting a head member, with an electrical connection unit for electrical connection with said head member.

2. Related Background Art

In an information processing apparatus such as a printer, a copying apparatus, a facsimile apparatus, a computer or a word processor, a reading head for reading image information recorded on an original sheet member or a recording head for recording an image on a recording sheet member according to image information is provided in an information processing area. Such head member as the reading or recording head is mounted, on a head mounting unit, together with an electrical connection for receiving electrical signals or driving electric power from the main body.

As an example, in the conventional information processing apparatus as disclosed in the Japanese Patent Laid-open Application No. 1-125238 and the U.S. Pat. No. 4,706,097, the carriage is provided with a connection unit for electrical connection with the recording head. Such electrical connection unit is schematically shown in a cross-sectional view in FIGS. 22A and 22B. For making electrical contacts between a recording head 7 and a printer main body, a carriage 50 is provided thereon with a rubber pad 57 consisting of an elastic member such as silicone rubber of a rubber hardness of 30° to 50°, and a contact portion 561 of a flexible circuit board 56 having protruding portions for contacting with contacts 78 of the recording head 7. As shown in FIGS. 22A and 22B, said rubber pad 57 is provided, on and under a slab 571, cylindrically protruding portions (contact pins) 572, 573 corresponding to the contact pads 561*a* of the flexible circuit board 56. For increasing the stability, a protruding rib (hereinafter called base rib) 574 is formed at an external edge of the rubber pad 57. In the contact portion 561 of the flexible circuit board 56, in positions corresponding to the contact pads 78*a*of the recording head 7, there are formed substantially square contact pads 561*a* in which protruding portions (hereinafter called dimples) 561*b* are formed for example by pressing. When the recording head 7 is mounted on the carriage 50, the rubber pad 57 is elastically crushed by a predetermined amount (L1–L2), whereby the contact portions 78, 561 of the recording head 7 and the flexible circuit board 56 are pressed under a predetermined pressure and the recording head is electrically connected with the main body of the recording apparatus.

As result of recent developments in the recording head and in the recording apparatus itself toward compactization and multiple functions, a higher density and a higher level of integration are required for the contact portion explained above, but the conventional contact portion as explained above have been associated with the following drawbacks:

(1) For achieving a higher density in the contact portion, the mutual distance between the base rib and the contact pins has been reduced. Consequently, in the conventional configuration in which the height of the base rib at the external edge is the same as that of the contact pins as shown in FIG. 22B, the contact pins are compressed under a pressure so acting as to reduce the height of the contact portion, while the external base rib is scarcely compressed because it is not subjected to such pressure, whereby the deformation takes place not only in the contact pins but also in the entire rubber pad. As a result, the contact pressure varies among the contact pins, with a larger contact pressure for the pins close to the base rib and a smaller contact pressure for those distant from the base rib, whereby the stability of the contact is adversely affected;

(2) Also for achieving a higher density in the contact portion, the mutual distance (pitch) of the contact pins 572, 573 in the contact pads is reduced. As a result, substantially square contact pads as shown in FIG. 16 occupy a larger proportion in the area of the base material of the flexible circuit board. For this reason the contact portion of the flexible circuit board shows a high rigidity, thus being more susceptible to the influence of the difference in the height of dimples or of the deformation of the flexible circuit board, whereby the stability of the contact is adversely affected.

SUMMARY OF THE INVENTION

An object of the present invention is to provide an information processing apparatus capable of providing stable electrical connection when a head member is mounted on a head mounting unit, and an elastic member to be provided in the electrical connecting unit in said information processing apparatus.

Another object of the present invention is to provide an elastic member capable of suppressing fluctuation in the pressure acting on protruding portions, for pressing electrical contacts of one side to those of the other side, provided in an electrical connecting portion between a head member and a head mounting unit.

Still another object of the present invention is to provide an information processing apparatus capable of providing stable electrical connection when a head member is mounted on a head mounting unit, even in case a pressing protruding portion for pressing a conductive contact to another provided in an electrical connecting portion between a head member and a head mounting unit comes close to another protruding portion, and an elastic member to be provided in the electrical connecting portion employed in said information processing apparatus.

Still another object of the present invention is to provide an elastic member provided in an electrical connecting portion for making electrical connection by the pressed contact of mutually opposed conductive contacts and adapted at least for pressing one of the conductive contacts to the other, said elastic member comprising:

a sheet portion;

a pressing protruding portion for pressing one of the conductive contacts to the other, said pressing protruding portion being so formed as to protrude from the top and rear faces of said sheet portion; and a protruding portion formed on the top or rear face of said sheet portion, with a protruding height smaller than that of said pressing protruding portion.

BRIEF DESCRIPTION OF THE DRAWINGS

FIGS. 4A to 4D are external views of a recording head to be mounted on the recording apparatus shown in FIG. 1, wherein FIG. 4A is a rear view of said recording head; FIG. 4B is a front view seen in a direction 4B in FIG. 4A; and FIG. 4C and FIG. 4D are lateral views seen respectively in directions 4C, 4D in FIG. 4A;

FIGS. 5A and 5B are front views of a carriage of the recording apparatus shown in FIG. 1, wherein FIG. 5A shows a state prior to complete mounting of the recording head; and FIG. 5B shows a state after complete mounting;

FIGS. 8A and 8B are views of a principal portion of a recording head mounting mechanism of the recording apparatus shown in FIG. 1, wherein FIGS. 8A and 8B are respectively a plan view and a front view;

FIGS. 9A and 9B are views showing the configuration of recording head fitting pins of the carriage of the recording apparatus shown in FIG. 1, wherein FIGS. 9A and 9B are respectively magnified views of fitting pins 505*b* and 505*a* in FIG. 7;

FIGS. 10A to 10C are schematic views showing assembled states of a front end portion of a flexible circuit board of the recording apparatus shown in FIG. 1, wherein FIG. 10A shows the assembled state of a front end portion 562 while FIGS. 10B and 10C show the states of insertion of the front end portion;

FIGS. 11A and 11B are views showing contact operation of the carriage of the recording apparatus shown in FIG. 1, wherein FIG. 11A shows a state prior to complete mounting of the recording head on the carriage, while FIG. 11B shows a state after complete mounting;

FIGS. 12A and 12B are views showing another contact operation of the carriage of the recording apparatus shown in FIG. 1, wherein FIG. 12A shows a state prior to complete mounting of the recording head on the carriage, while FIG. 12B shows a state after complete mounting;

FIGS. 13A and 13B are views showing still another contact operation of the carriage of the recording apparatus shown in FIG. 1, wherein FIG. 13A shows a state prior to complete mounting of the recording head on the carriage, while FIG. 13B shows a state after complete mounting;

FIGS. 14A and 14B are views showing still another contact operation of the carriage of the recording apparatus shown in FIG. 1, wherein FIG. 14A shows a state prior to complete mounting of the recording head on the carriage, while FIG. 14B shows a state after complete mounting;

FIGS. 15A and 15B are views showing configuration of a rubber pad in the carriage of the recording apparatus shown in FIG. 1, wherein FIG. 15A and FIG. 15B are respectively a plan view and a cross-sectional view;

FIGS. 18A and 18B are views showing still another contact operation of the carriage of the recording apparatus shown in FIG. 1, wherein FIG. 18A shows a state prior to complete mounting of the recording head on the carriage, while FIG. 18B shows a state after complete mounting;

FIGS. 19A and 19B are views showing still another contact operation of the carriage of the recording apparatus shown in FIG. 1, wherein FIG. 19A shows a state prior to complete mounting of the recording head on the carriage, while FIG. 19B shows a state after complete mounting;

FIGS. 20A and 20B are views showing still another contact operation of the carriage of the recording apparatus shown in FIG. 1, wherein FIG. 20A shows a state prior to complete mounting of the recording head on the carriage, while FIG. 20B shows a state after complete mounting;

FIGS. 21A and 21B are views showing still another contact operation of the carriage of the recording apparatus shown in FIG. 1, wherein FIG. 21A shows a state prior to complete mounting of the recording head on the carriage, while FIG. 21B shows a state after complete mounting; and FIGS. 22A and 22B are views showing a contact operation of the carriage of a conventional recording apparatus, wherein FIG. 22A shows a state prior to complete mounting of the recording head on the carriage, while FIG. 22B shows a state after complete mounting.

DETAILED DESCRIPTION OF THE PREFERRED EMBODIMENTS

Figure 1:
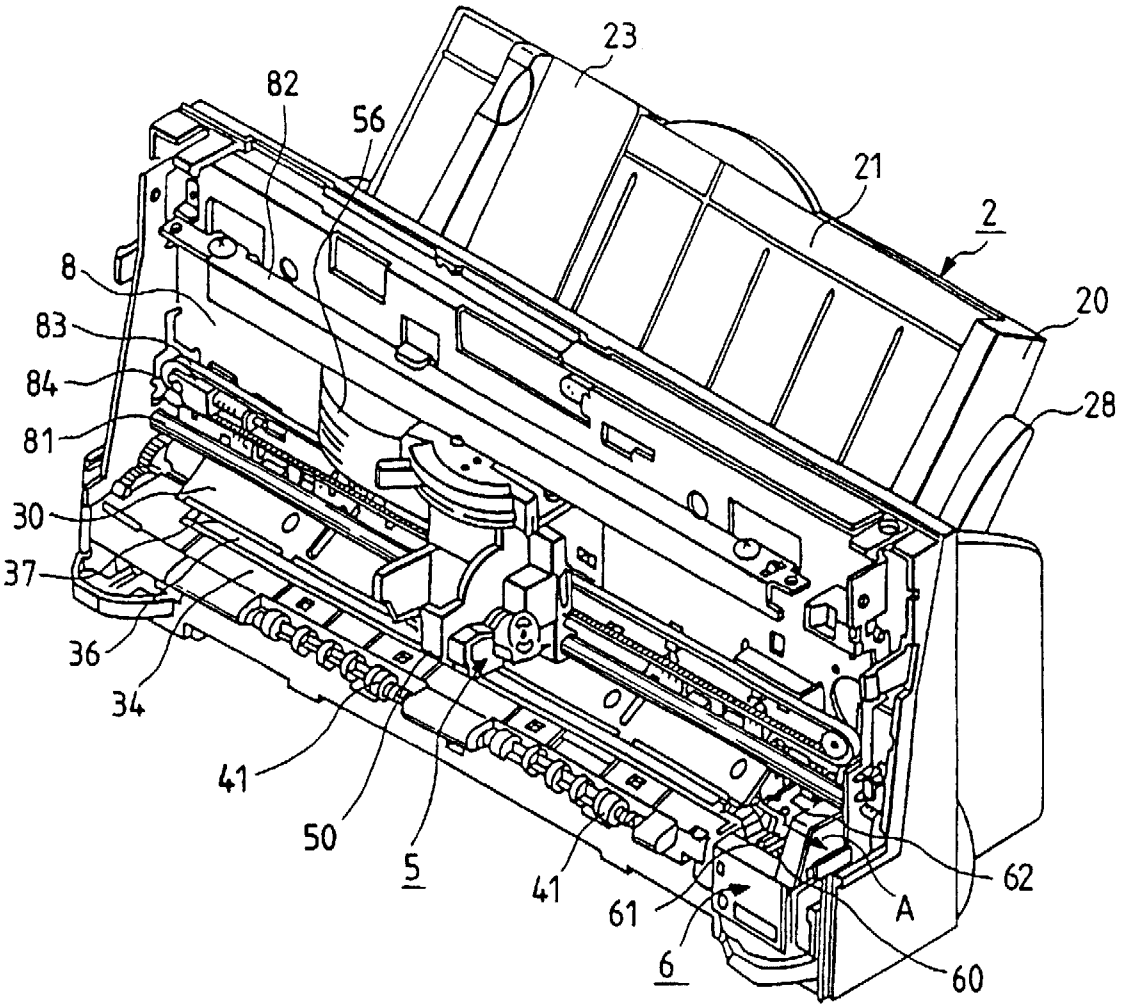
FIG. 1 is a perspective view showing the entire configuration of a recording apparatus, constituting a first embodiment of the present invention.
Figure 2:
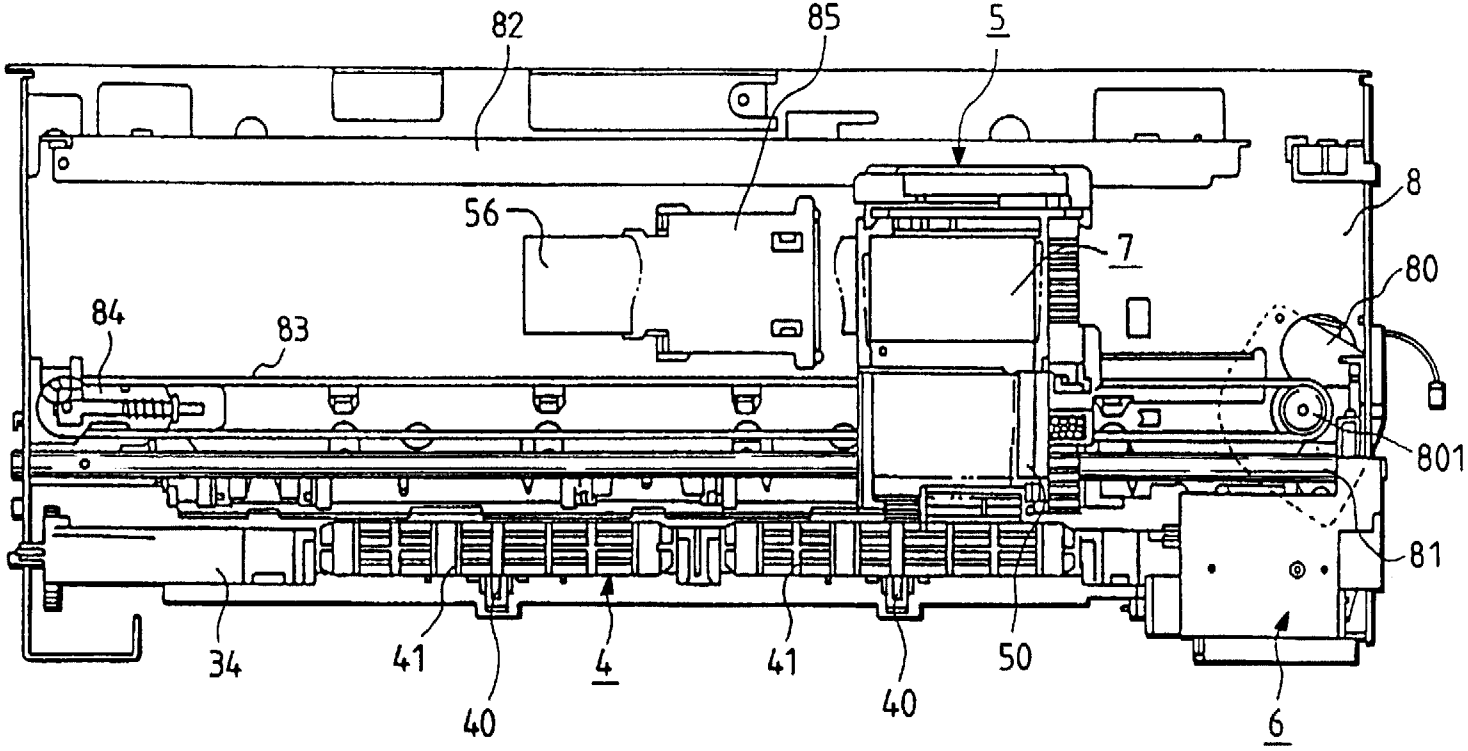
FIG. 2 is a front view of the recording apparatus shown in FIG. 1.
Figure 3:
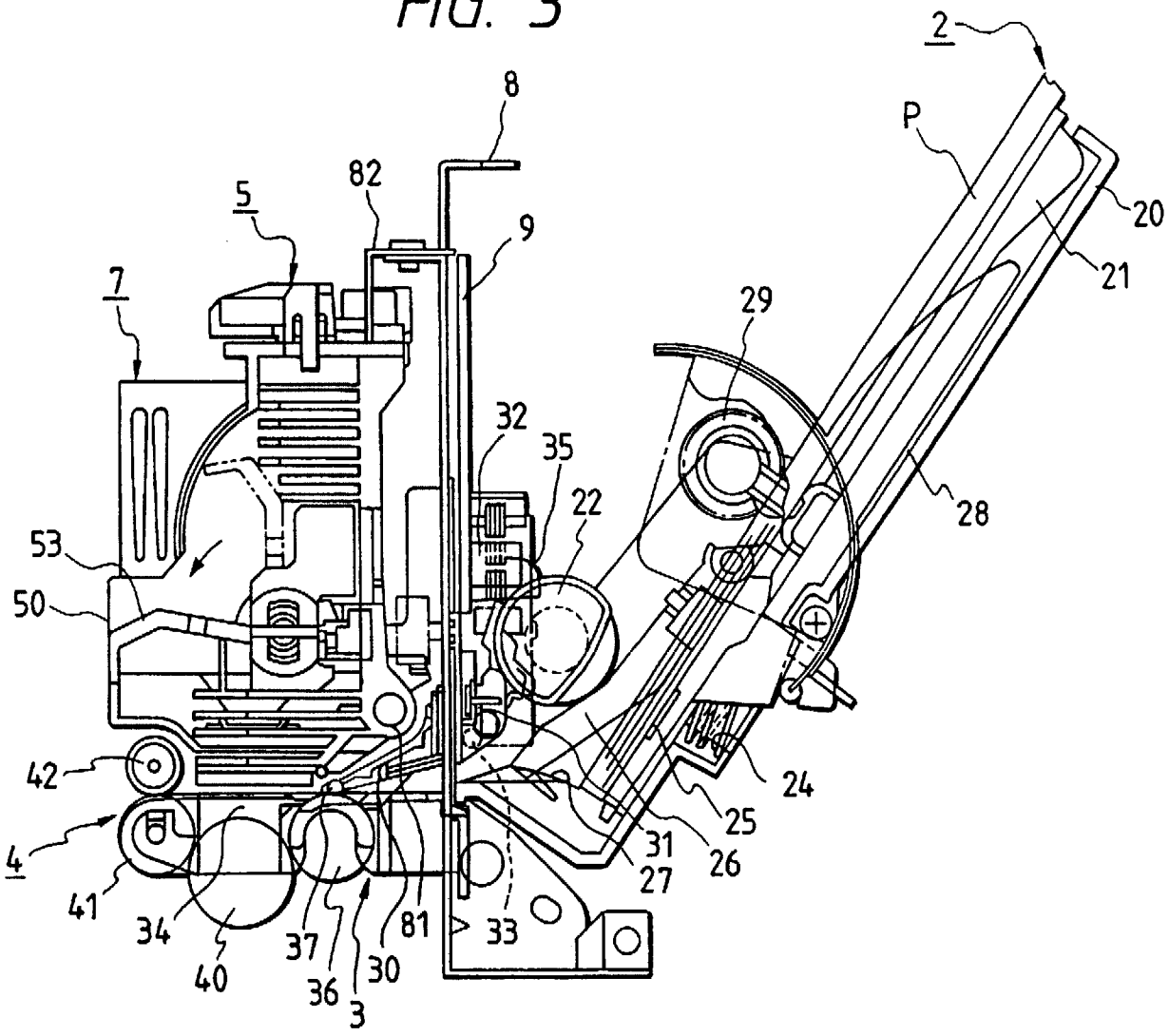
FIG. 3 is a cross-sectional view of the recording apparatus shown in FIG. 1.
Figure 4A:
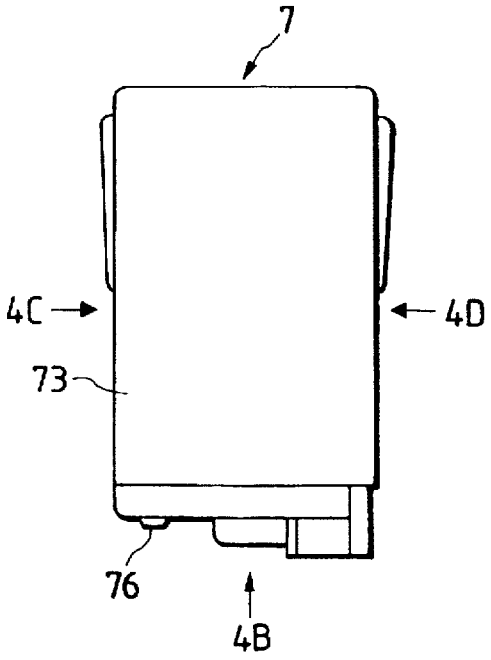
Figure 4B:
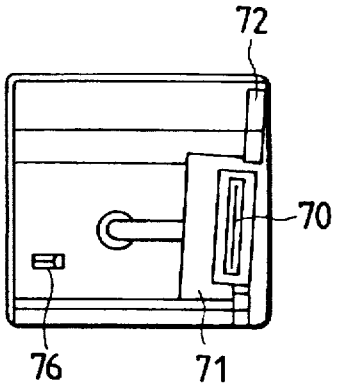
Figure 4C:
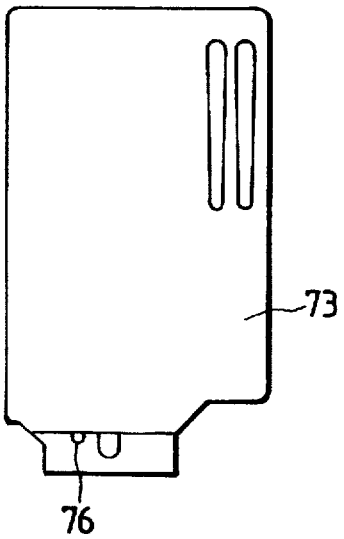
Figure 4D:
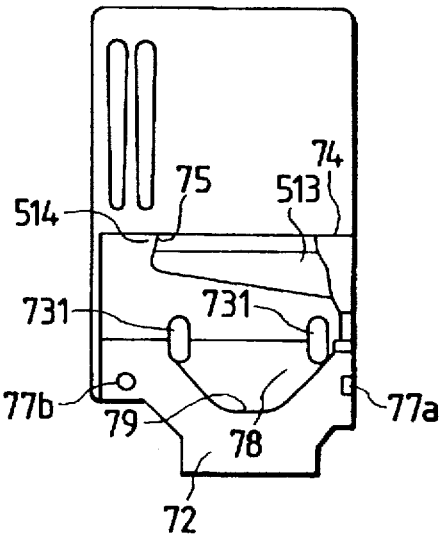

Now the present invention will be clarified in detail by preferred embodiments thereof shown in the attached drawings.

The information processing apparatus in which the present invention is applicable is to be provided with a head mounting unit on which a reading head or a recording head is mounted, for effecting a reading or recording operation on a sheet member positioned in an information processing area, wherein the head member is mounted, with electrical connection, to a head mounting member on the head mounting unit. In case the head member to be mounted on the information processing apparatus is a recording head, it may assume a form of integrally mounting a recording head and an ink tank, for ink supply thereto, to the head mounting unit, a form of separately constructing a recording head and an ink tank and mounting the recording head, provided with an ink tank holder, on the head mounting unit and also mounting the ink tank on said ink tank holder, or a form of mounting a recording head only on the head mounting unit while the ink tank is provided in the main body of the recording apparatus.

(A) Sheet feeding unit

A sheet feeding unit 2 is composed of a pressure plate 21 for stacking sheet members P and a feeding rotary member 22 for feeding the sheet members P, both mounted on a base member 20. Said pressure plate 21 is provided with a movable side guide 23, for defining the stacking position of the sheet members P. The pressure plate 21 is rendered rotatable about a rotary shaft linked to the base 20, and is biased toward the feeding rotary member 22 by a pressure plate spring 24. In a position of the pressure plate 21, opposed to the feeding rotary member 22, there is provided a separating pad 25 composed of a material of a high frictional coefficient, such as artificial leather, for preventing superposed feeding of the sheet members P. The base is further provided with a separating finger 26 for covering a corner in a direction of the sheet members P thereby separating said sheet members one by one; a bank portion 27 molded integrally with the base for separating card boards or the like which are not separable with the separating finger 26; a switch lever 28 for activating the separating finger 26 in an ordinary paper position and deactivating said separating finger in a board position; and a release cam 29 for releasing the pressure plate 21 from the contact with the feeding rotary member 22.

In the above-explained configuration, the release cam 29 depresses the pressure plate 21 to a predetermined position in a stand-by state, whereby the pressure plate 21 is released from the contact with the feeding rotary member 22. When the driving force of a transport roller 36 is transmitted, through gears, to the feeding rotary member 22 and the release cam 29, it is disengaged from the pressure plate 21, whereby the pressure plate is lifted and the feeding rotary member 22 comes into contact with the sheet members P. Thus, by the rotation of the feeding rotary member 22, the sheet member P is picked up, separated individually by the separating finger P and fed to a sheet transport unit 3. The feeding rotary member 22 and the release cam 29 rotate until the sheet member P is fed into the sheet transport unit 3, and then enter the stand-by state in which the sheet members P is detached from the feeding rotary member 22, whereupon the driving from the transport roller 36 is terminated.

(B) Sheet transport unit

The sheet transport unit 3 is provided with a transport roller 36 for transporting the sheet members P and a PE sensor 32. The transport roller 36 is associated with an idler pinch roller 37, which is supported by a pinch roller guide 30 and biased by a pinch roller spring whereby the pinch roller 37 is maintained in pressed contact with the transport roller 36 for generating a transporting force for the sheet member P. At the entrance of the sheet transport unit 3, receiving the transported sheet member P, there are provided an upper guide 33 and a platen 34 for guiding the sheet member P. The platen 34 serves to guide the front end of the sheet member P in the information processing area. In the upper guide 33 there is provided a PE sensor lever 35 for transmitting the detections of the front and rear ends of the sheet members P to the PE sensor 32. Also at the downstream side of the transport roller 36, in the transport direction of the sheet member, there is provided a recording head 7 for forming an image based on image information.

In the above-explained configuration, the sheet member P supplied to the sheet transport unit 3 is guided by the platen 34, pinch roller guide 30 and upper guide 33, and advanced to the paired rollers 36, 37. In this operation the PE sensor lever 35 detects the front end of the transported sheet member P, whereby the print position on the sheet member P is determined. The sheet member P is transported on the platen 34, by the rotation of the paired rollers 36, 37 by an unrepresented LF motor.

The recording head 7 is composed of an easily replaceable ink jet recording head, constructed integrally with an ink tank. In said recording head 7, heat can be given to the ink for example with a heater. The ink causes film boiling by said heat, and is discharged from a nozzle 70 of the recording head 7 by a pressure change induced by the growth or contraction of a bubble generated by said film boiling, whereby an image is formed on the sheet member P.

(C) Carriage unit

A carriage unit 5 is provided with a carriage 50 for mounting the recording head 7. The carriage 50 is supported by a guide shaft 81 for causing reciprocating scanning motion in a direction perpendicular to the transport direction of the sheet member P, and a guide rail 82 for supporting the rear end of the carriage 50 thereby maintaining a gap between the recording head 7 and the sheet member P. The guide shaft 81 and the guide rail 82 are mounted on a frame 8. The carriage 50 is driven, through a timing belt 83, by a carriage motor 80 mounted on the frame 8. Said timing belt 83 is maintained under a tension by an idler pulley 84. The carriage 50 is further provided with a flexible circuit board 56 for transmitting signals from an electrical board 9 to the recording head 7.

In the above-explained configuration, for image formation on the sheet member P, the sheet member P is transported by the paired rollers 36, 37 to a line position (position in the transport direction of the sheet member P) for image formation while the carriage 50 is moved by the carriage motor 80 to a column position (position in a direction perpendicular to the transport direction of the sheet member P) for image formation, whereby the recording head is brought to a position opposed to the image forming position. Thereafter the recording head discharges ink toward the sheet member P according to the signals from the electrical board 9, thereby forming an image.

(D) Sheet discharge unit

In a sheet discharge unit 4, a transmission roller 40 is provided in contact with said transport roller 36 and also with a discharge roller 41, whereby the rotation of the transport roller 36 is transmitted, through said transmission roller 40, to the discharge roller 41. Also a spur wheel 42 is maintained in contact with the discharge roller 41, so as to be rotated thereby. Thus the sheet member P subjected to image formation in the carriage unit 5 is pinched in the nip between the discharge roller 41 and the spur wheel 42 and is discharged onto an unrepresented discharge tray.

(E) Cleaning unit

A cleaning unit 6 is composed of a pump 60 for cleaning the recording head 7, a cap 61 for avoiding the drying thereof, and a drive switching arm 62 for switching the driving force from the transport roller 36 either to the sheet feeding unit 2 or to the pump 60. Except in sheet feeding or cleaning, a planet gear (not shown) rotating about the axis of the transport roller 36 is fixed at a predetermined position, whereby the driving force is transmitted neither to the sheet feeding unit 2 nor to the pump 60. When the drive switching arm 62 is moved in a direction A by a movement of the carriage 50, the planet gear is moved according to the forward or reverse rotation of the transport roller 36, whereby the driving force is transmitted to the sheet feeding unit 2 or to the pump 60 respectively when the transport roller rotates in the forward or reverse direction.

In the following there will be explained the principal parts of the carriage unit 5 on which the recording head can be mounted.

Figure 5B:
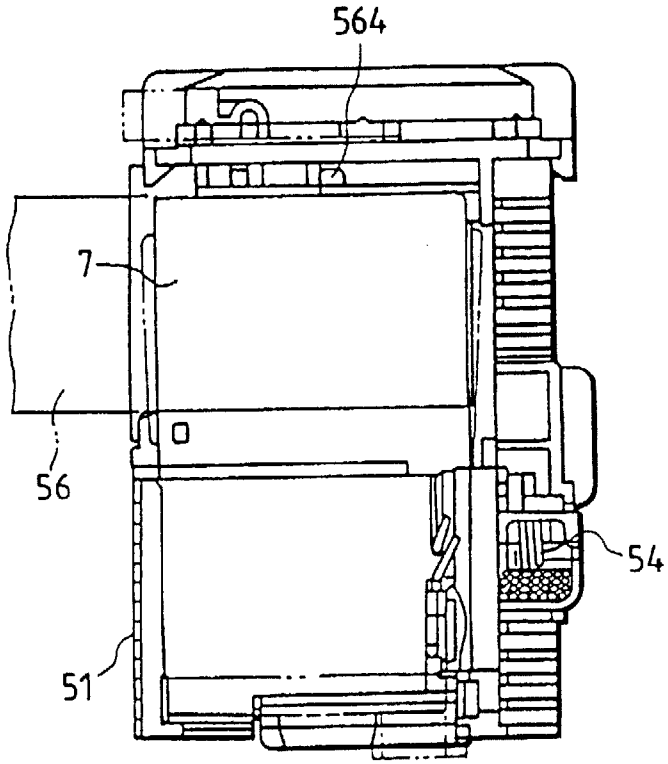
Figure 5A:
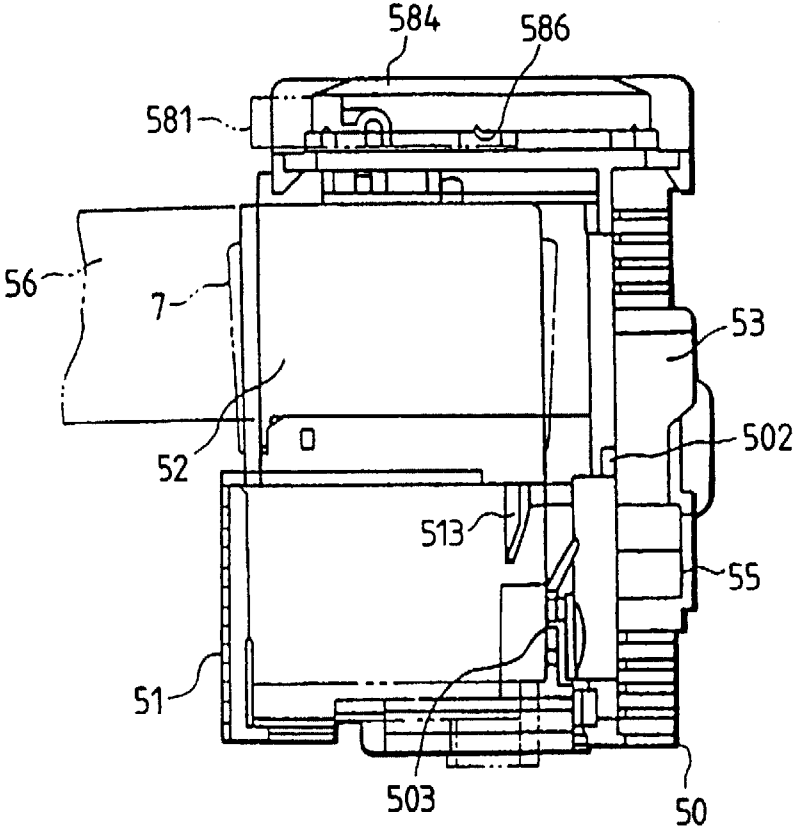
Figure 6:
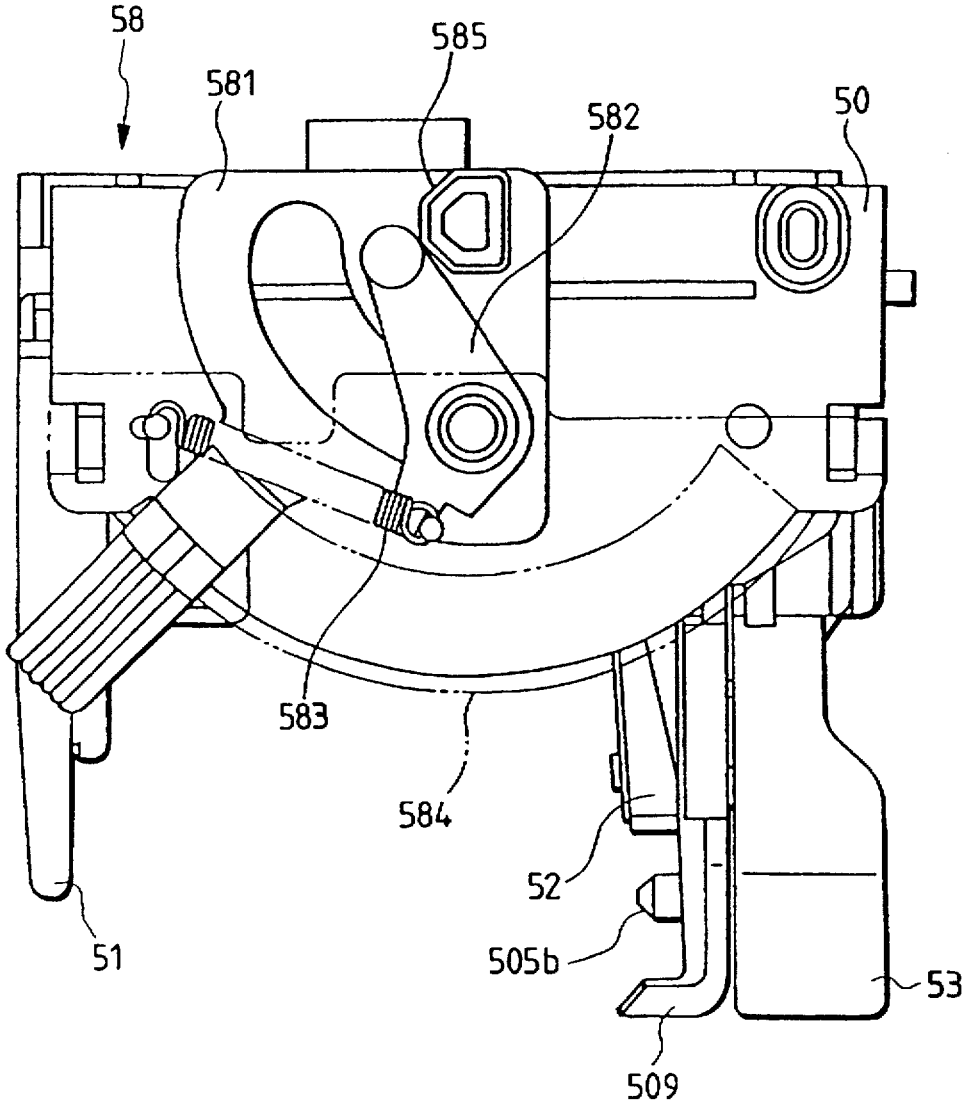
FIG. 6 is a plan view of the carriage of the recording apparatus shown in FIG. 1.
Figure 7:
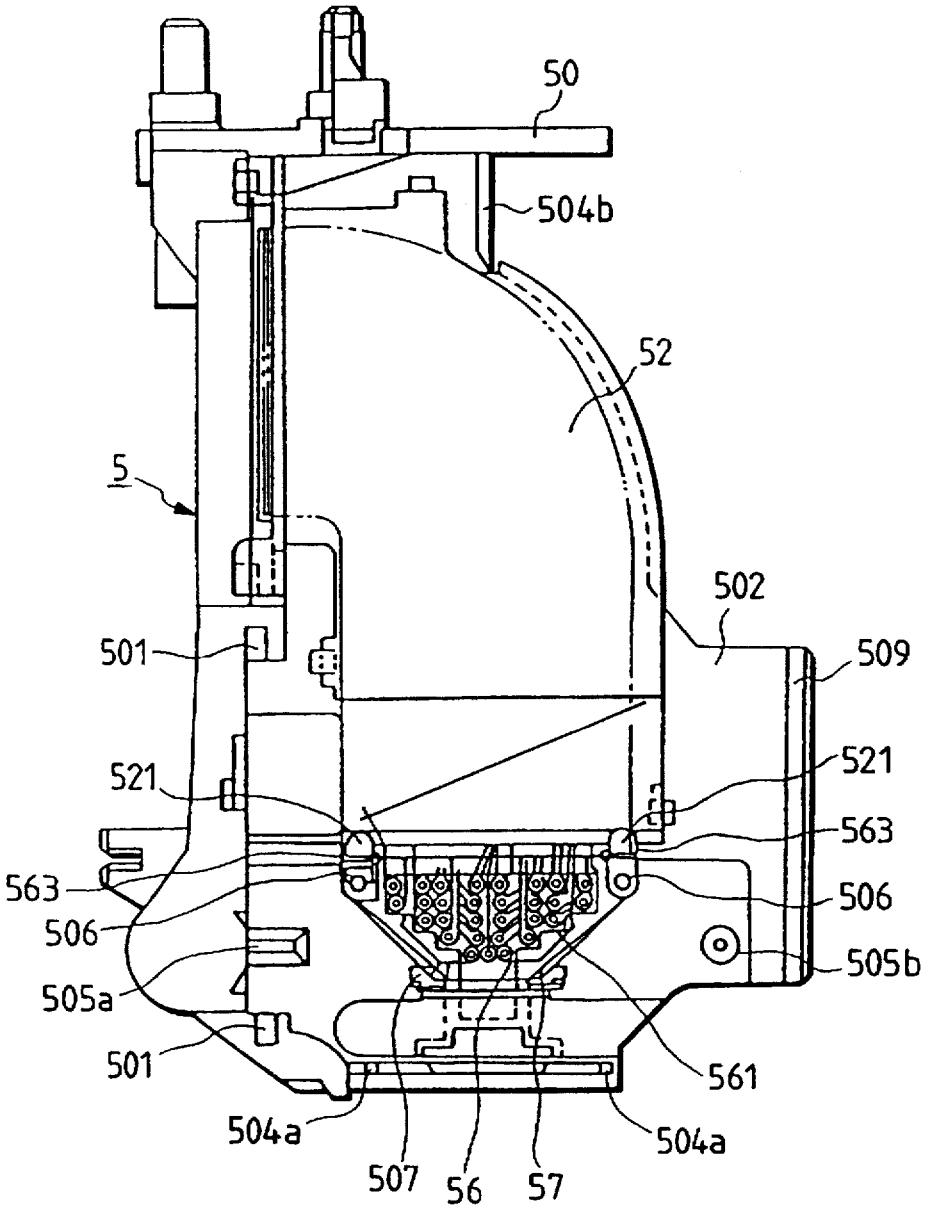
FIG. 7 is a view of a contact portion of the carriage of the recording apparatus shown in FIG. 1.

A mounting portion for the recording head 7 is composed, as shown in FIGS. 5A and 5B, of a carriage 50, a head holder 51, a base cover 52, a hook lever 53, a contact spring 54, a hook cover 55, a flexible circuit board 56 and a rubber pad 57 (cf. FIG. 7).

As shown in FIGS. 5A and 5B, the head holder 51 is rendered laterally slidable, with the head 7 thereon, along a guide 501 (cf. FIG. 7) provided on the carriage 50. The head holder 51 is provided with a guide portion 511 for guiding the head 7 and a pressing portion 512 (cf. FIGS. 8A and 8B) for pressing the head 7 toward a contact face 503 and a position defining face 504 of a lateral plate 502 vertically standing on the carriage 50. The position of the lateral plate 502 of the carriage is defined by three points, two (504*a*) being on a base plate 72 in the vicinity of the nozzle 70 of the head 7, and one (504*b*) being above the ink tank 73 of the head 7. A contact face 503 of the carriage 50 with the head 7 is so constructed as to be positioned inside a triangle formed by said three position defining points 504*a*, 504*b*. The pressing position of the pressing portion 512 of the head holder 51 is positioned inside said triangle. Opposed to the pressing portion 512 of the head holder 51 there is provided a guide arm 513, which acts on the head 7 when it is detached from the contact face 503. On the lateral plate 502 of the carriage 502, there is provided a rib 509 serving as a guide at the mounting or detaching of the head 7 and also as protection of a contact face 561 of the flexible circuit board 56 as will be explained later.

As shown in FIGS. 4A to 4D, the recording head 7 is provided with a guide 74 on a lateral face of the ink tank 73, and is mounted along the upper face of the aforementioned guide arm 513. Corresponding to the predetermined mounting position of the head 7, the guide 74 of the head 7 is provided with a recess 75, while the head holder 51 is provided, at a corresponding position, with a protruding portion 514 as position defining means. Also the head 7 is provided with a protruding portion 76 on the bottom face, while a corresponding recess 515 is formed in a receiving portion of the head holder 51. Thus, in mounting the head 7, the nozzle face 70 is prevented from colliding with the platen 34, so that the head 7 can be protected from damage. Also a clock can be felt at the head mounting, so that secure mounting can be assured. Also the engagement of the protruding portion 514 of the head holder 51 avoids the fall in front of the head 7 at the mounting or detaching thereof and the unstable positional displacement thereof after the mounting.

Figure 8A:
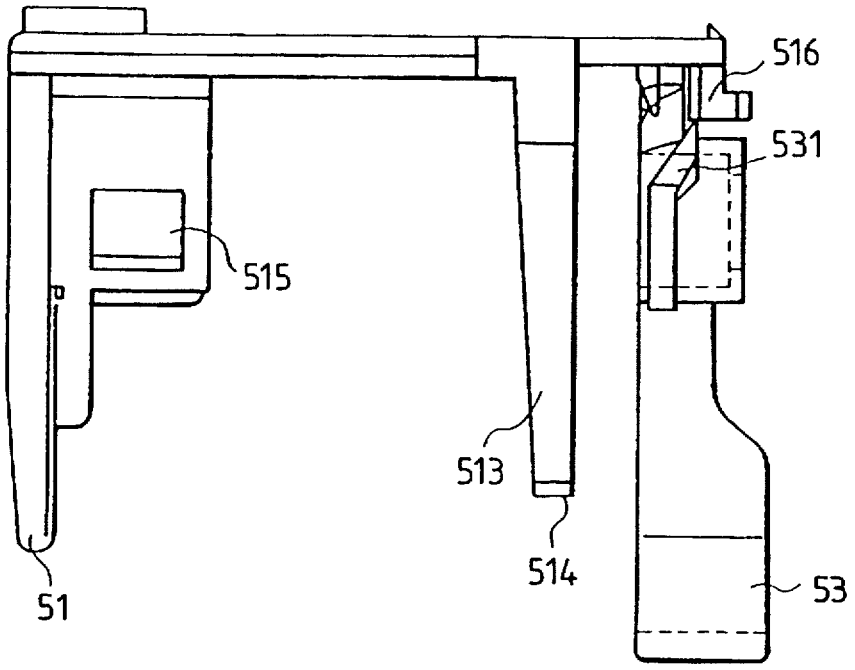
Figure 8B:
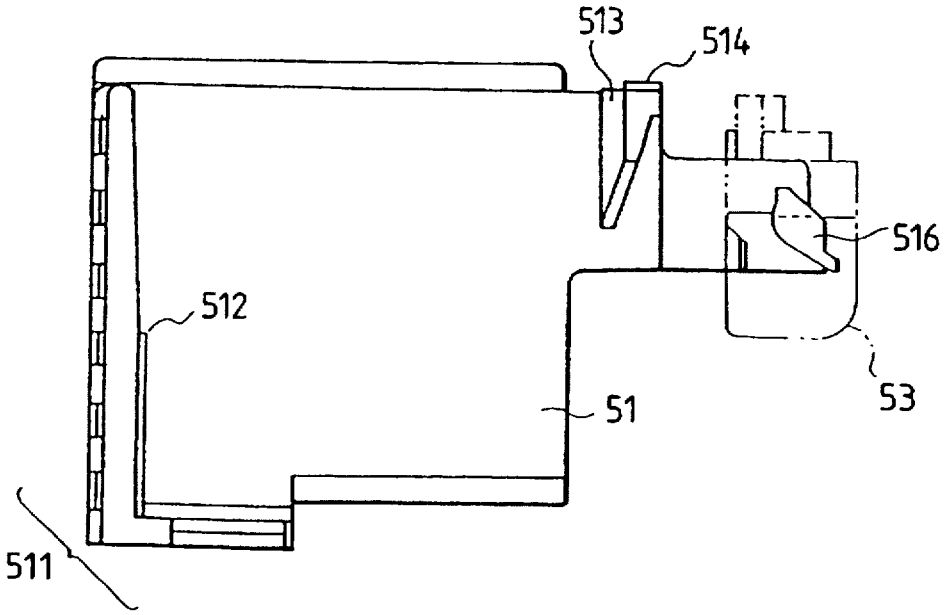

The hook lever 53 is rotatably mounted on the lateral plate 502 of the carriage 50. At the rotary center of the hook lever 53, there is provided a contact spring 54 for biasing the hook lever 53 in the direction indicated by an arrow. The hook cover 55 is so provided as to cover the hook lever 53, thereby preventing the same from detaching out of the carriage 50. The hook lever 53 and the head holder 51 are provided, as shown in FIGS. 8A and 8B, respectively with mutually engaging cams 516, 531 whereby the head holder 51 moves laterally by the rotation of the hook lever 53. Also the biasing force of the aforementioned contact spring 54 functions, through the hook lever 53, to press the head 7 toward the head holder 51.

Figure 9A:
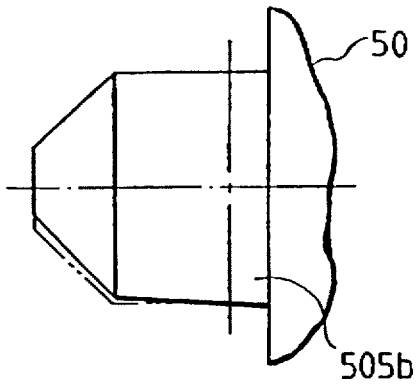
Figure 9B:
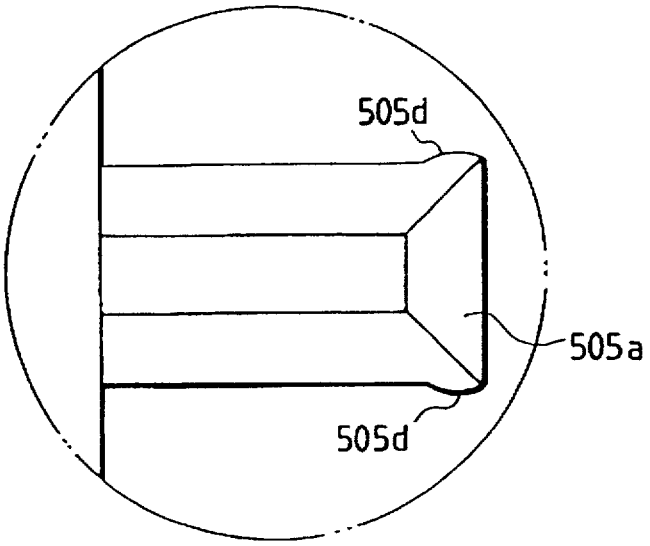

The lateral plate 502 of the carriage 50 is provided with a fitting pins 505 for defining the position of the head 7. As shown in FIGS. 7, 9A and 9B, there are provided two fitting pins 505*b* corresponding to fitting holes 77*a*, 77*b* in the base plate 72 of the head 7 (cf. FIGS. 4A to 4D). In consideration of the driving operation of the head 7, the base plate 72 thereof is inclined by about 1° to 4° with respect to the scanning direction of the carriage unit 5. In consideration of such inclined configuration, one of the fitting holes 77 of the base plate 72 of the head 7 is formed as a square hole 77*a*, and the corresponding fitting pin 505*a* of the carriage 50 is formed as a partially cylindrical square pin. Also the fitting pin 505*b* of the carriage, corresponding to the circular hole 77*b*, is constructed free of an undercut portion, in consideration of the structure of the carriage, whereby the fitting is achieved in a position where the head 7 impinges on the position defining face 504 of the carriage. Such configuration enables exact and smooth positioning of the head 7 to the inclined base plate 72, without requiring a complex structure. Furthermore, a tapered portion is provided over the entire structure, whereby the contact face 561 of the flexible circuit board 56 and the contact face 78 of the head 7 mutually slide from the starting position of contact to the final head set position. Consequently these contact faces 78, 561 are refreshed at each mounting or detaching operation of the head 7, thereby avoiding defective contact resulting for example from contaminant particles.

Figure 10A:
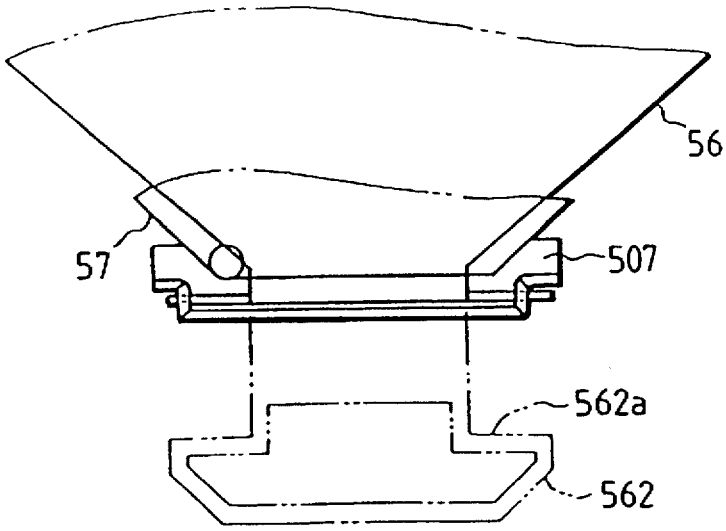
Figure 10B:
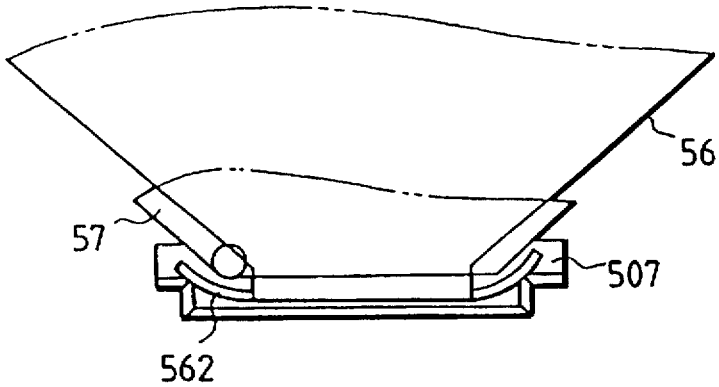
Figure 10C:
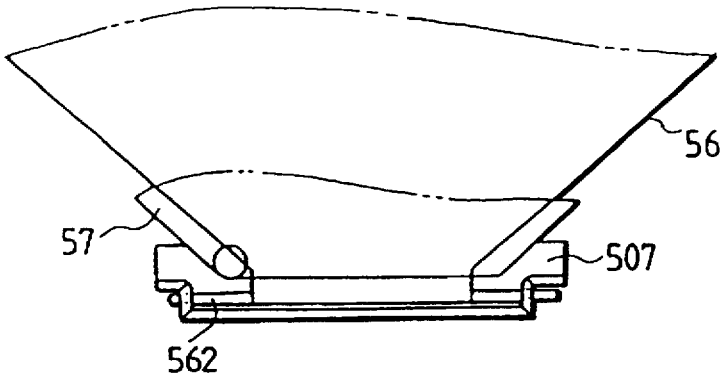

On a contact face 503 of the lateral plate 502 of the carriage 50, there are provided, as shown in FIG. 7, a rubber pad 57 consisting of an elastic member such as of silicone rubber of a rubber hardness of 30° to 50° and the contact portion 561 of the flexible circuit board 56, for making electrical contact with the head 7. The rubber pad 57 and the flexible circuit board 56 are both maintained in place by a positioning pin 506 provided on the lateral plate 502 of the carriage 50. The flexible circuit board 56 is provided with a slit 563 at the opposite side of the positioning portion of said board, across the contact portion 561, whereby said contact portion 561 is maintained free of the eventual deformation in the assembly of the flexible circuit board 56. The contact portion 561 of the flexible circuit board 56 is pointed toward the front end 562, matching the shape of the base plate 72 of the head 7, with an engaging portion 562*a* at the end. Such triangular shape of the contact portion 561, with the progressively decreasing number of the contact pads toward the front end facilitates formation of the signal lines and achieves a higher density. Also the handling of the front end portion 562 of the flexible circuit board 56 can be facilitated. On the lateral plate 502 of the carriage 50 there is provided a slit hole 507 for inserting said end portion 562 of the flexible circuit board 56 (of. FIG. 7). As shown in FIGS. 10A to 10C, said end portion 562 is inserted into the slit hole 507 in a bent state. Once passing through the slit hole 507, the end portion 562 returns to the straight state and engages with the slit hole 507, thereby no longer extractable therefrom. With this configuration, the front end portion is maintained free, whereby the contact face 561 of the flexible circuit board 56 is not rigid and can achieve satisfactory contact with the contact face of the head 7. When the head 7 is mounted, the contact face 503 of the carriage 50 enters a notch 79 of the base plate 72 of the head 7 and comes into contact with a contact face 78 of the board formed inside said notch 79.

Figure 11A:
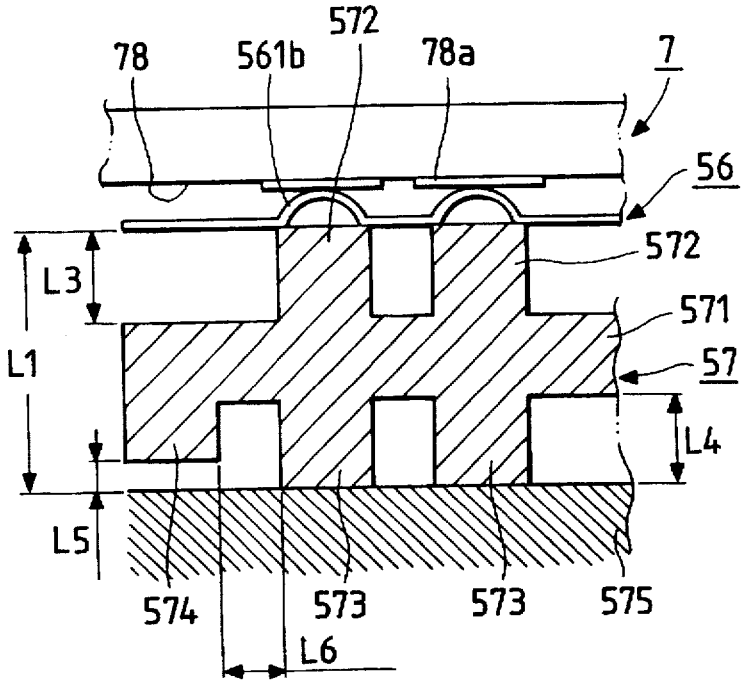
Figure 11B:
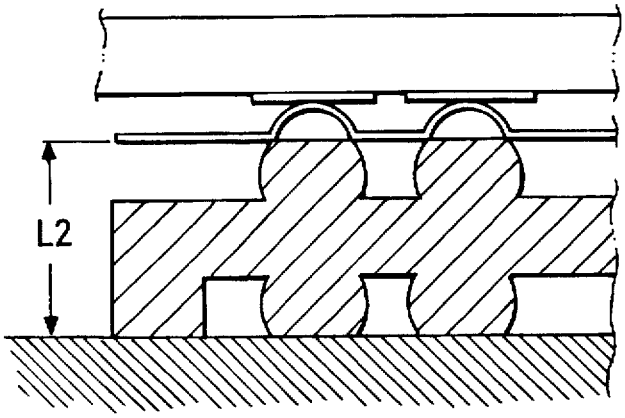

In the following there will be explained behavior of the rubber pad 57 when the recording head 7 and the flexible circuit board are mutually contacted. As shown in FIGS. 11A and 11B, said rubber pad 57 is provided, above and below a sheet portion 571, with protruding pressing portions 572, 573 (hereinafter called contact pins) corresponding to the contact pads 561*a* of the flexible circuit board 56. For improving stability, a rib 574 (hereinafter called base rib) is formed at an external edge (or peripheral portion) of the rubber pad 57. The height of said base rib 574 is made smaller by L5 than that L4 of the contact pins 573 in the same direction. The contact pins 573 are cylindrical projections with a diameter of 0.3 to 1 mm and with a height L3 or L4 of 0.5 mm to 0.7 mm. The sheet portion 571 has a thickness (L1–L3–L4) of about 0.5 mm, and the distance L6 between the contact pin 573 and the external rib 574 is from 2 mm to 4 mm. The rubber pad 57, having the sheet portion of a size of ca. 20 mm×ca. 10 mm, is maintained in contact with the recording head under a pressure of ca. 0.5 kg to ca. 2 kg, whereby the entire thickness L1 of said rubber pad 57 is compressed to 1 mm to 1.2 mm. In such state, the amount of compression of the sheet portion 571 is much smaller than that of the contact pins 572, 573, so that there stands the following relationship:

$$L5=(L4/(L3+L4))\times(L1-L2)$$

Under this relationship, the recording head 7 is mounted on the carriage 50, by compression of the rubber pad 57 by a predetermined amount of 0.3 mm to 1.0 mm, corresponding to L1–L2. In the above-mentioned situation the amount of compression of the contact pins 572 becomes approximately equal to L5, so that, in the mounted state of the recording head 7, the base rib 574 comes into contact with the contact face 503 of the carriage while the sheet portion 571 remains substantially flat (of FIG. 11B). Because of such limited bending deformation of the sheet portion 571 of the rubber pad 57 at the head mounted state, the contact pressures of the contact pins become more uniform and the stability of contact can be well maintained or improved. Also at the mounting of the recording head 7, the base rib 574 is brought into contact with the contact face 503 of the carriage, so that the stability of mounting of the rubber pad 57 is not adversely affected. In such state, the base rib 574 is in contact with a carriage body 575 to stably support the rubber pad 57 with respect to the carriage 50.

Figure 12A:
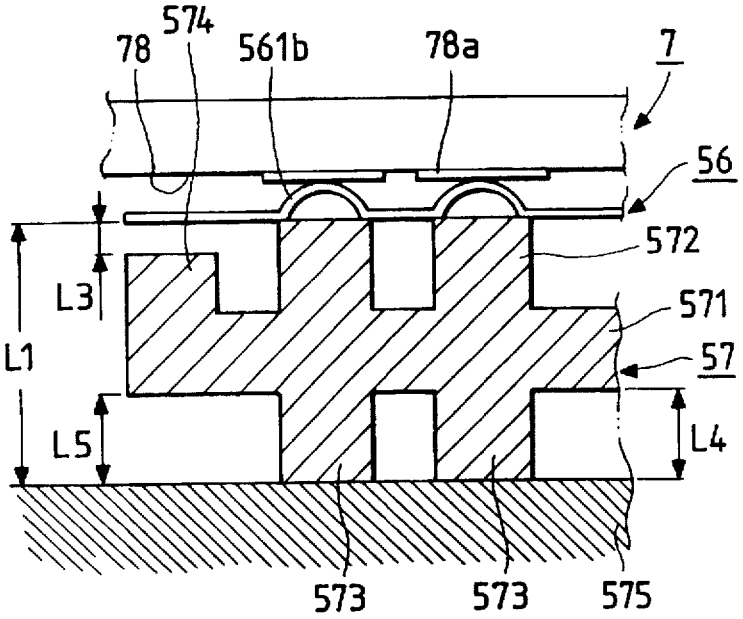
Figure 12B:
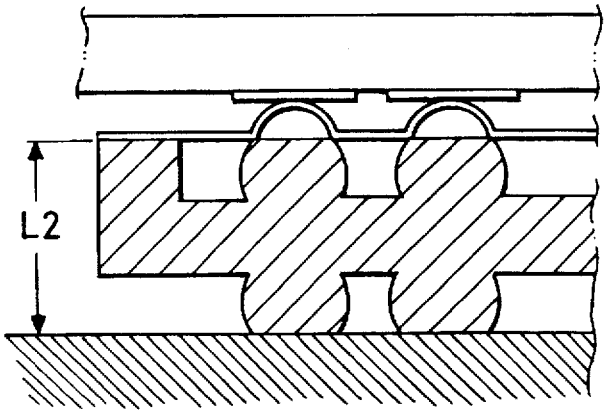
Figure 13A:
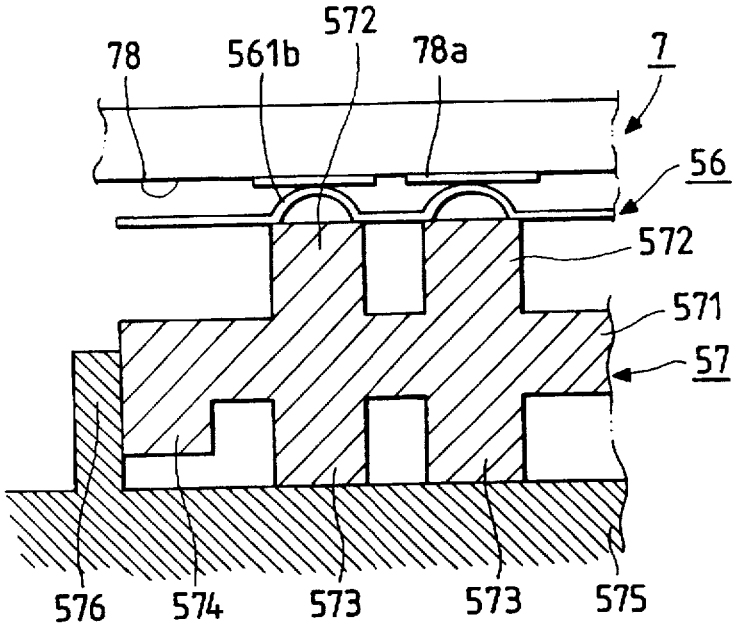
Figure 13B:
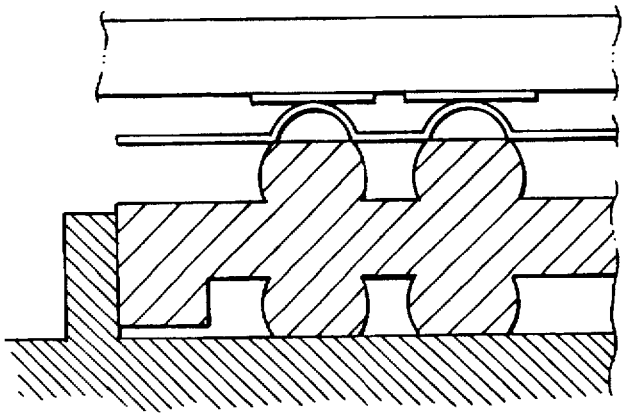
Figure 14A:
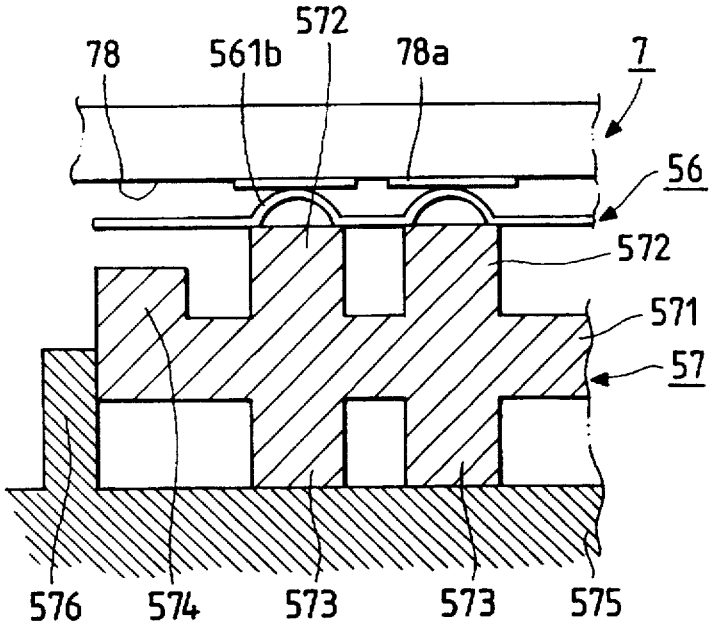
Figure 14B:
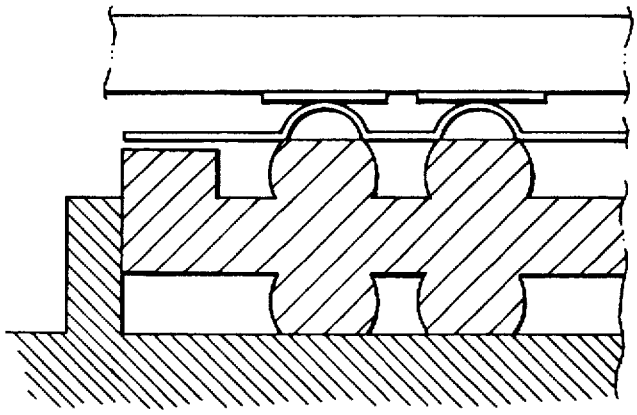
Figure 15A:
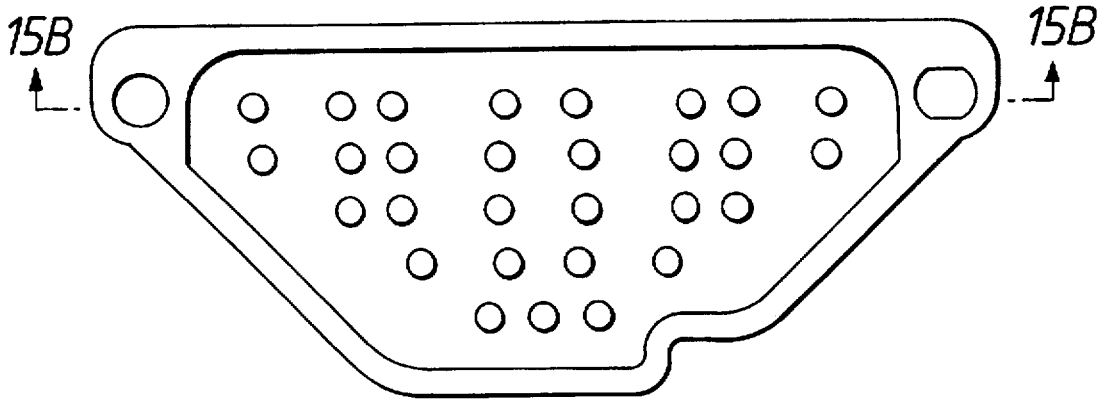
Figure 15B:
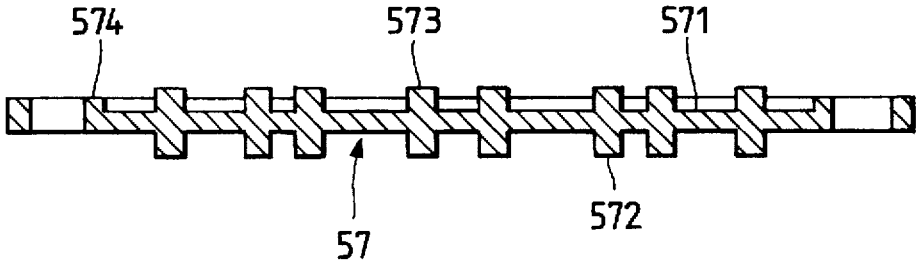

In the rubber pad 57 shown in FIGS. 12A and 12B, the base rib 574 protrudes toward the flexible circuit board 56. At the mounted state of the recording head 7, the compressed height of the contact pins 572 becomes approximately equal to the height of the base rib 574, it comes into contact with the flexible circuit board 56 while the sheet portion 571 remains substantially flat (cf. FIG. 12B). Because of such limited bending deformation of the sheet portion 571 of the rubber pad 57 at the head mounted state, the contact pressures of the contact pins become more uniform and the stability of contact can be well maintained or improved. Also at the mounting of the recording head 7, the base rib 574 is brought into contact with the contact face 503 of the carriage, so that the stability of mounting of the rubber pad 57 is not adversely affected. In such state, the base rib 574 is in contact with the flexible circuit board 56 to stably support the rubber pad 57 with respect thereto.

In the rubber pads 57 shown in FIGS. 13A, 13B, 14A and 14B, the base rib 574 as shown in FIGS. 11A and 11B is maintained in contact, at a lateral face thereof, with a lateral face of the position defining portion 576 of the carriage body 575 to laterally receive the pressure at the mount of the recording head 7 on the carriage 50, thereby defining the position of the rubber pad 57 with respect to the carriage 50. The base rib 574, which is brought into contact with the carriage body 575 in the configuration shown in FIGS. 11A and 11B at the head mounting, need not necessarily be brought into contact with the carriage body 575 in the configuration shown in FIGS. 13A and 13B, and need not necessarily be brought into contact with the flexible circuit board 56 in the configuration shown in FIGS. 14A and 14B, and still similar effects can be attained.

Figure 16:
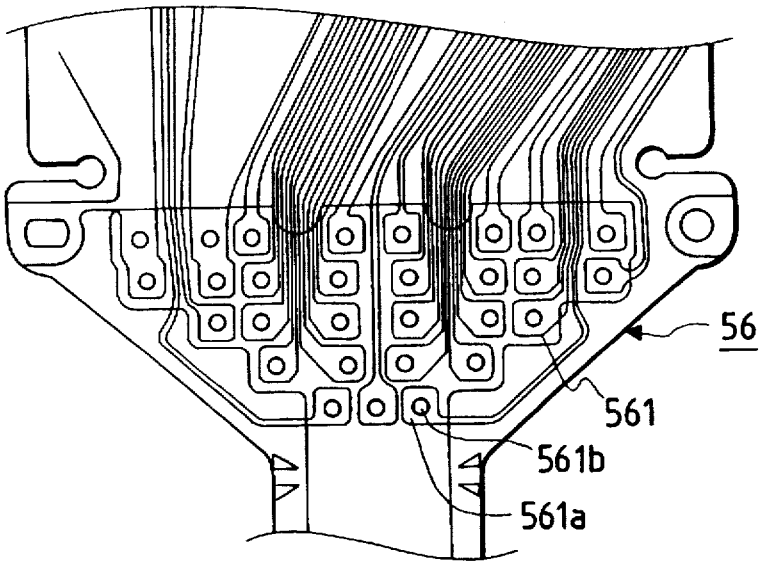
FIG. 16 is a view showing the shape of contacts in the flexible circuit board of the carriage of the recording apparatus shown in FIG. 1.

As shown in FIG. 16, the contact portion 561 of the flexible circuit board 56 is provided with square contact pads **561*a* in positions corresponding to the contact pads 78*a* of the recording head 7, and protruding portions 561*b* (hereinafter called dimples) are formed therein for example by pressing. When the recording head 7 is mounted on the carriage 50, the rubber pad 57 is compressed as explained before, whereby the contact portions 78, 561 of the head 7 and the flexible circuit board 56 are maintained in contact under a contact pressure of 20 g to 70 g per pin to electrically connect the head 7** and the main body of the printer.

The flexible circuit board 56 is positioned along the lateral plate 502 of the carriage 50, then bent perpendicularly and fixed to the carriage 50 by the base cover 52. The flexible circuit board 56 is provided with an extended portion 564 for tentative fixing and can be fixed by engaging said extended portion 564 with the carriage 50, so that the mounting of the base cover 52 can be achieved efficiently. Besides the base cover 52 is provided with a holding portion 521 in such a manner that the position defining holes of said rubber pad 57 and the flexible circuit board 56 do not detach from the pin 506 on the carriage 50. On the other hand, the recording head 7 is provided with a recess 731 for escaping from said position defining pin 506 and the extended holding portion 521 of the base cover 52. Consequently there can be employed the position defining pin 506 of a sufficient length and the holding portion 521 of the base cover 52 with a sufficient thickness, so that the rubber pad 57 and the flexible circuit board 56 can be positioned and maintained in place firmly. The flexible circuit board 56 is fixed to the frame 8 by a fixing plate 85, and varies its curvature according to the position of the carriage unit 5, whereby said flexible board transmits the head drive signals from the electric board 9 to the head 7, following the movement of the carriage unit 5.

The above-explained configuration facilitates the mounting, supporting, positioning and electrical contact of the head 7 to the carriage unit 5.

Figure 17:
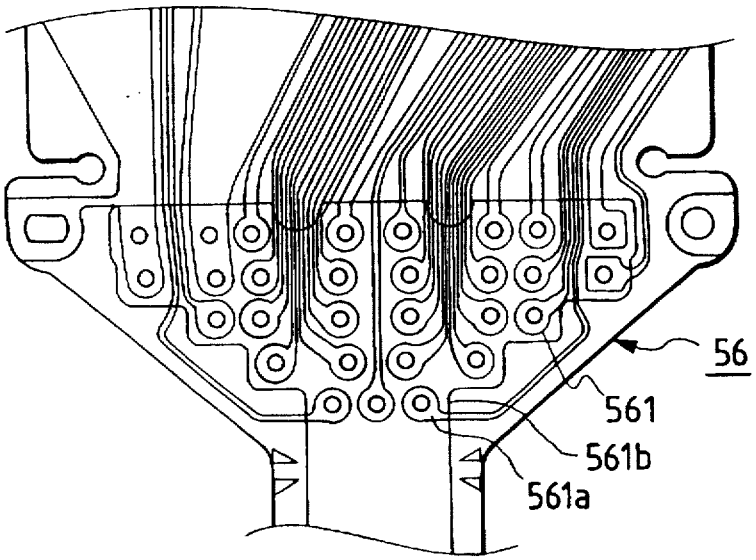
FIG. 17 is a view showing the shape of contacts in another flexible circuit board of the carriage of the recording apparatus shown in FIG. 1.
Figure 18A:
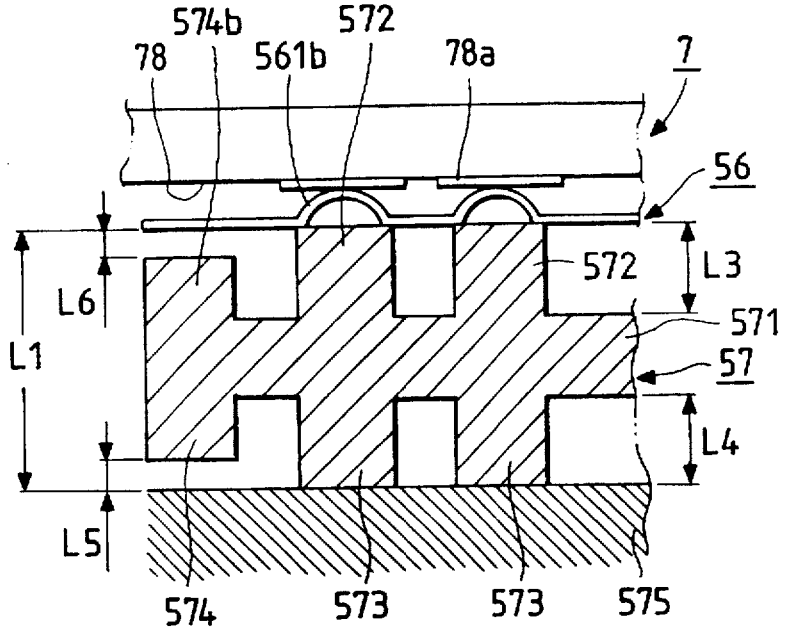
Figure 18B:
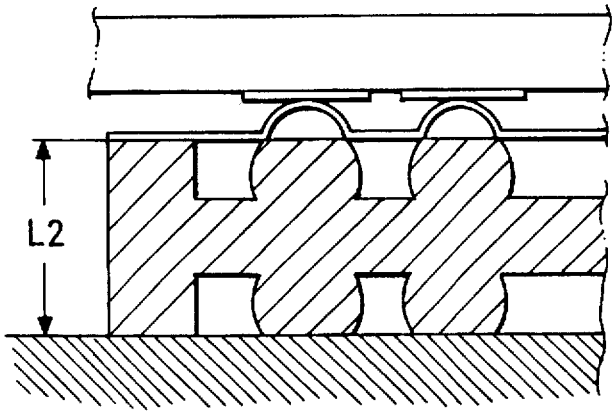
Figure 19A:
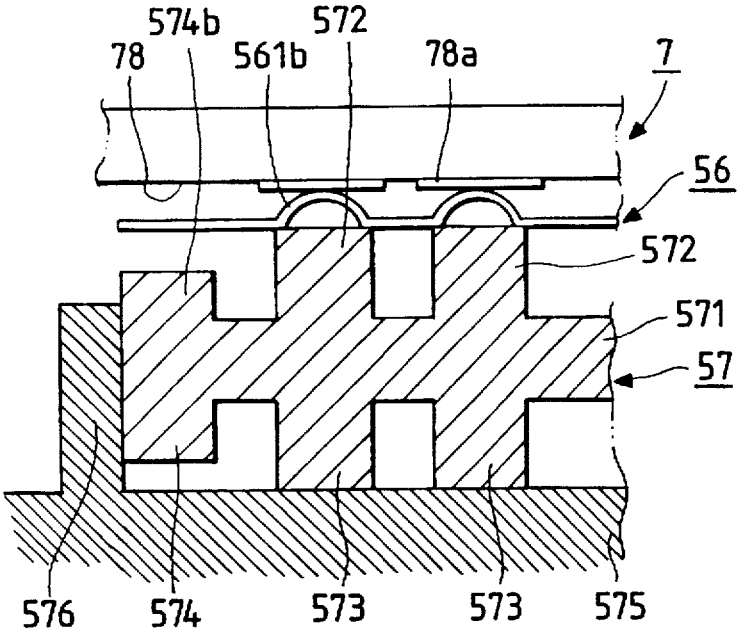
Figure 19B:
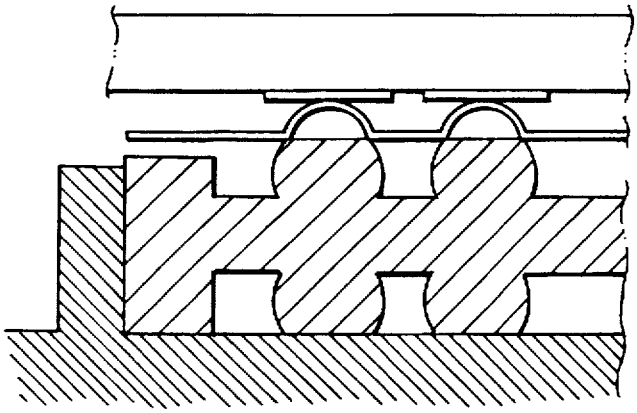
Figure 20A:
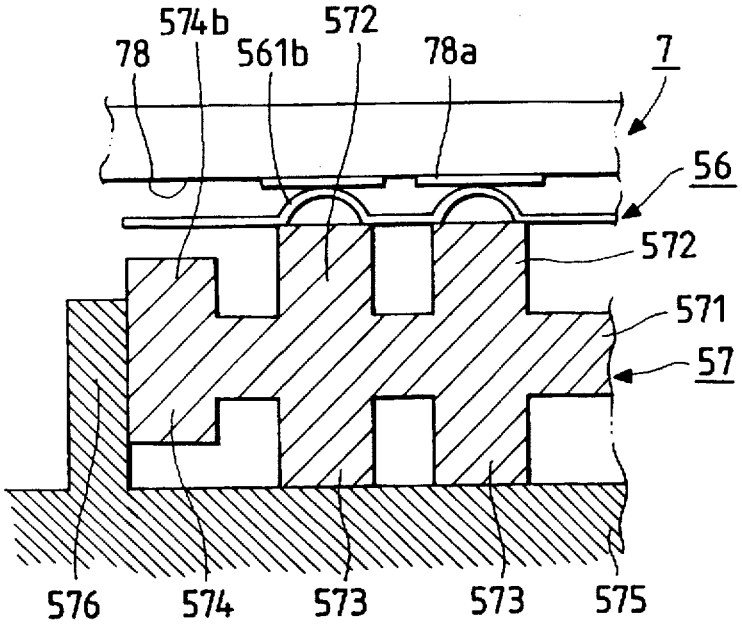
Figure 20B:
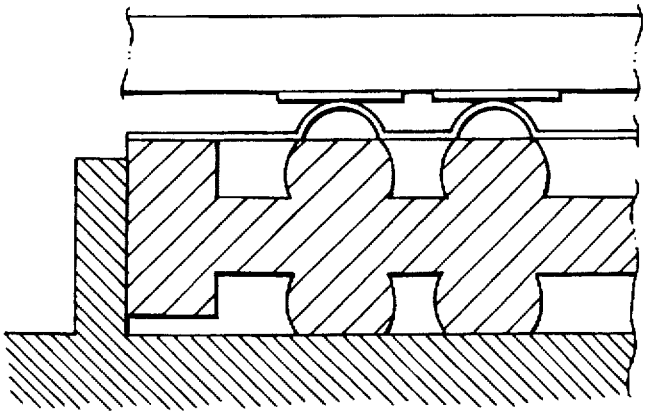
Figure 21A:
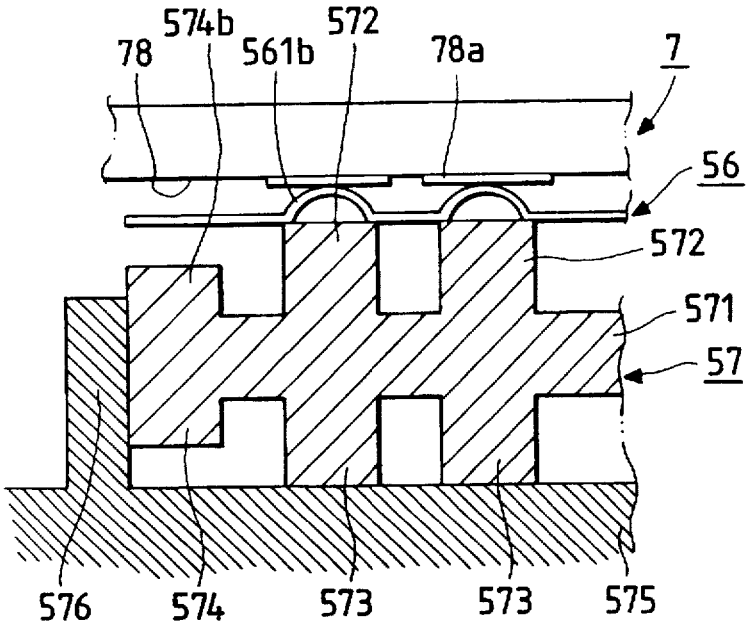
Figure 21B:
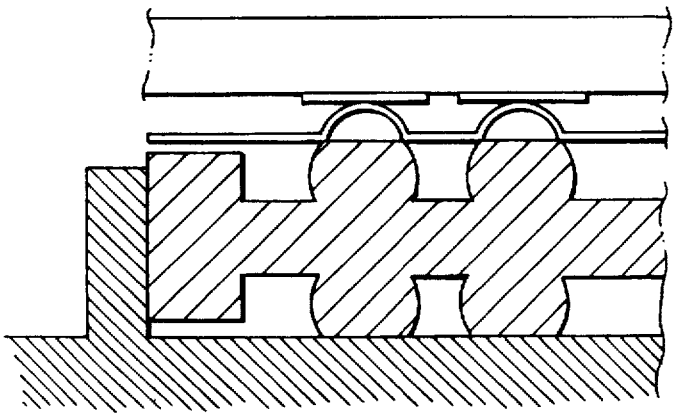
Figure 22A:
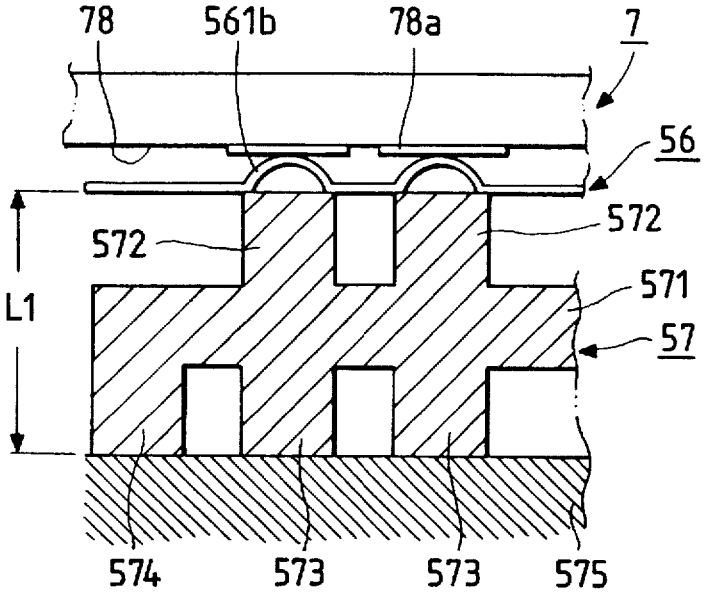
Figure 22B:
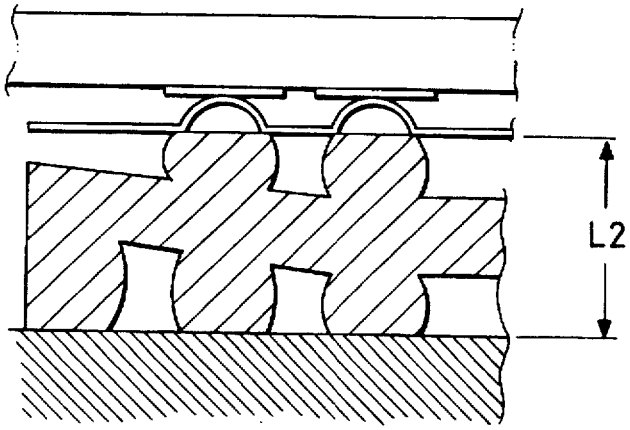

In the foregoing embodiments, the contact portion 561 of the flexible circuit board 56 is provided with square contact pads **561*a*, in which the dimples 561*b* are formed for example by pressing. However, the contact pads 561*a* are preferably shaped circularly, as shown in FIG. 17. The flexible circuit board 56 is composed of a base material for example of polyimide, and a conductor for example of roller copper, adhered thereto in the form of contact pads 561*a* of a predetermined shape. In consideration of the modulus of elasticity, the rigidity of the contact portion 561 of the flexible circuit board 56 is mostly determined by the ratio of area occupied by the contact pads 561*a*. On the other hand, because of the process for forming the above-mentioned dimples 561*b*, each contact pad 561*a* has to be extended by a certain amount around the dimple 561*b*. As the dimple 561*b* is ordinarily formed semispherically in consideration of its function and the process of forming, the ratio of area occupied by the contact pads 561*a* can be reduced by the use of circular contact pads 561*a***.

The above-mentioned configuration suppresses the increase in the rigidity of the contact portion **561*a* of the flexible circuit board 56, thereby reducing the influence of the fluctuation in height of the dimples or of the deformation of the flexible circuit board 56**, and maintaining or improving the stability of contact.

Also in the foregoing embodiments, the rubber pad 57 is provided with the base rib 574 only at one side, but base ribs 574, **574*b* may be provided on both sides as shown in FIGS. 18A to 21B**.

As explained in the foregoing, the base rib 574 is made lower, by L5, than the height L4 of the contact pins 573 in the same direction. As the amount of compression of the sheet portion 571 itself of the rubber pad 57 is much smaller than that of the contact pins 572, 573, there stands the following relation:

$$L5=(L4/(L3+L4))\times(L1-L2)$$

Also the base rib **574*b* is made lower, by L6, than the height L3 of the contact pins 572 in the same direction. As the amount of compression of the sheet portion 571 of the rubber pad 57 is much smaller than that of the contact pins 572, 573**, there stands the following relation:

$$L6=(L3/(L3+L4))\times(L1-L2)$$

The above-explained configuration can improve the flatness of the contact portion 561 of the flexible circuit board 56, as it can be supported by the external peripheral portion of the rubber pad 57. The reduced deformation, such as bending, of the sheet portion 571 of the rubber pad 57 at the head mounting reduces the fluctuation in contact pressure of the contact pins, thereby maintaining or improving the stability in contact.

In configurations shown in FIGS. 19A to 21B, in which the rubber pad 57 is positioned with respect to the carriage 50 by impingement of a lateral face of protruding portions 574, 574*b* of the rubber pad 57 on a lateral face of the position defining portion 576 of the carriage body 575, the deformation such as bending of the sheet portion 571 of the rubber pad 57 can be limited at the head mounting, even if the end face of at least either of the base ribs 574, 574*b* is not in contact with the carriage body 575 or the flexible circuit board 56. Consequently it is rendered possible to reduce the fluctuation in contact pressure of the contact pins, thereby maintaining or improving the stability of contact.

Also by forming the pins 572 and 573 with a same height, the rubber pad 57 can have the same structure on the top and rear sides, whereby there can be achieved improved assembling property and reduction of mistakes in assembling.

In the foregoing embodiments, the height of the base rib is selected the same as that of the contact pins compressed by a predetermined amount in the head set state, but the reduction of fluctuation in the contact pressure in the head set state can be achieved by merely selecting the height of the base rib smaller than that of the contact pins.

Also even in case the base rib is positioned closer to the contact pins as a result of a higher density configuration of the contact portion, the rubber pad shows smaller deformation such as bending because the height of the base rib is the same as that of the contact pins compressed by a predetermined amount in the head set state. Consequently it is rendered possible to reduce the fluctuation in contact pressure of the contact pins and to maintain or improve the stability of contact.

Also even in case the pitch of the contact pads is reduced as a result of a higher density configuration of the contact portion, it is made possible to suppress the ratio in area of the conductors on the base material in the contact portion of the flexible circuit board, by employing circular contact pads instead of the conventional square ones, thereby minimizing the increase in rigidity of the contact portion of the flexible circuit board. It is thus rendered possible to reduce the influence of the fluctuation in height of the dimples and of the deformation of the flexible circuit board, thereby maintaining or improving the stability of contact.

What is claimed is:

1. An elastic member for use in an electrical connecting portion for effecting electrical connection by pressing at least one of mutually opposed conductive contact portions together, comprising:

a sheet portion having first and second opposite faces;

pressing portions for pressing the conductive contact portions together, said pressing portions protruding from said first and second faces of said sheet portion; and a protruding portion protruding from either one or both of said first and second faces of said sheet portion, with said protruding portion having a protruding height smaller than that of said pressing portion protruding from said same face of said sheet portion.

2. An elastic member according to claim 1, wherein the protruding height of said protruding portion from said sheet portion when electrical connection is made by pressing the mutually opposed conductive contact portions is substantially the same as the height of said pressing portions when elastically compressed.

3. An elastic member according to claim 1, wherein the protruding height of said protruding portion from said sheet portion when electrical connection is made by pressing the mutually opposed conductive contact portions is smaller than the height of said pressing portions when elastically compressed.

4. An elastic member according to claim 1, wherein said protruding portion is provided at an external peripheral portion of said sheet portion and outside an area where said pressing portions are provided.

5. An information processing apparatus for processing information on a sheet material with a head member provided in an information processing area, comprising:

a head mounting unit for mounting said head member;

a board provided with a contact portion and provided in said head mounting unit for effecting electrical connection with said head member mounted on said head mounting unit;

a sheet member having first and second opposite faces;

pressing members for pressing said contact portion toward said head member, said pressing portions protruding from said first and second faces of said sheet member; and a protruding member protruding from said sheet member, with said member having a protruding height smaller than that of said pressing members protruding from said same face of said sheet member.

6. An information processing apparatus according to claim 5, wherein the protruding height of said protruding member from said sheet member when electrical contact is made by pressing said head member and said board with said contact portion is substantially the same as the protruding height of said pressing members when elastically compressed.

7. An information processing apparatus according to claim 5, wherein the protruding height of said protruding member from said sheet member when electrical contact is made by pressing said head member and said board with said contact portion is smaller than the protruding height of said pressing members when elastically compressed.

8. An information processing apparatus according to claim 5, wherein said protruding member is provided at an external peripheral area of said sheet member outside an area where said pressing members are provided.

9. An information processing apparatus according to claim 5, wherein said head member is an ink jet recording head for discharging ink.

10. An information processing apparatus according to claim 5, wherein said head member is an ink jet recording head provided with an electrothermal converting member for discharging ink utilizing thermal energy generated by said electrothermal converting member.

11. A recording apparatus comprising:

recording head mounting means for detachably mounting a recording head for forming an image on a recording medium;

electrical connection means for effecting electrical connection with said recording head;

a flexible circuit board in which said electrical connection means includes a contact portion in a position corresponding to a contact portion of said recording head; and a sheet-shaped elastic member capable of pressing said flexible circuit board toward said contact portion of said recording head, said sheet-shaped elastic member including pressing portions protruding from both sides of said sheet-shaped member in a position corresponding to said contact portion to said flexible circuit board and a protruding portion extending from a side of said sheet-shaped member, wherein said protruding portion has a height smaller than a height of said pressing portions and is disposed at a peripheral portion of said sheet-shaped member.

12. A recording apparatus according to claim 11, wherein the height of said protruding portion when electrical contact is made by pressing said contact portion of said recording head and that of said flexible circuit board is substantially the same as the height of said pressing portions when elastically compressed.

13. A recording apparatus according to claim 11, wherein the height of said protruding portion when electrical contact is made by pressing said contact portion of the recording head and that of said flexible circuit board is smaller than the height of said pressing portions when elastically compressed.

14. A recording apparatus according to claim 11, wherein said recording head is an ink jet recording head for discharging ink.

15. A recording apparatus according to claim 11, wherein said recording head is an ink jet recording head provided with an electrothermal converting member and discharges ink utilizing thermal energy generated by said electrothermal converting member.

* * * * *

UNITED STATES PATENT AND TRADEMARK OFFICE

CERTIFICATE OF CORRECTION

PATENT NO. : 5,801,728

DATED : September 1, 1998

INVENTOR(S) : Yanagi et al.

It is certified that error appears in the above-identified patent and that said Letters Patent is hereby corrected as shown below:

On the title page, Item [56],

REFERENCES CITED:

FOREIGN PATENT DOCUMENTS, "1125238
1148566
1209786
2299858" should read
--1-125238
1-148566
1-209786
2-299858--.

COLUMN 1:

Line 43, "78aof" should read --78a of--.

Signed and Sealed this

Eleventh Day of May, 1999

*Attest:*

*Attesting Officer*

Q. TODD DICKINSON

*Acting Commissioner of Patents and Trademarks*